US006263961B1

(12) United States Patent
Antoine

(10) Patent No.: US 6,263,961 B1
(45) Date of Patent: Jul. 24, 2001

(54) SPIRAL HEAT EXCHANGER

(75) Inventor: Hubert Antoine, Earneux (BE)

(73) Assignee: Ateliers de Construction de Thermo Echangeurs S.A., Ans (BE)

( * ) Notice: Subject to any disclaimer, the term of this patent is extended or adjusted under 35 U.S.C. 154(b) by 0 days.

(21) Appl. No.: 09/308,647

(22) PCT Filed: Jul. 28, 1997

(86) PCT No.: PCT/BE97/00088

§ 371 Date: Dec. 2, 1999

§ 102(e) Date: Dec. 2, 1999

(87) PCT Pub. No.: WO98/05916

PCT Pub. Date: Feb. 12, 1998

(30) Foreign Application Priority Data

Aug. 5, 1996 (EP) ..... 96202200

(51) Int. Cl.[7] ..... F28D 7/02
(52) U.S. Cl. ..... 165/164; 165/DIG. 398
(58) Field of Search ..... 165/164, 165, 165/166, DIG. 398

(56) References Cited

U.S. PATENT DOCUMENTS

| | | | | |
|---|---|---|---|---|
| 2,663,549 | * | 12/1953 | Otten | 165/164 X |
| 3,854,530 | | 12/1974 | Jouet et al. . | |
| 4,073,340 | | 2/1978 | Parker . | |
| 4,089,370 | * | 5/1978 | Marchal | 165/DIG. 398 |
| 4,124,069 | * | 11/1978 | Becker | 165/164 |
| 4,546,826 | * | 10/1985 | Zitzmann | 165/164 X |
| 5,273,106 | | 12/1993 | Drake . | |
| 5,505,255 | * | 4/1996 | Viessmann | 165/164 |
| 5,797,449 | | 8/1998 | Oswald et al. . | |

FOREIGN PATENT DOCUMENTS

| | | | | |
|---|---|---|---|---|
| 11 21 090 | | 1/1962 | (DE) . | |
| 32 34 878 | | 3/1984 | (DE) . | |
| 1058090 | * | 3/1954 | (FR) | 165/164 |
| 2 319 868 | | 2/1977 | (FR) . | |
| 291593 | * | 6/1928 | (GB) | 165/164 |

OTHER PUBLICATIONS

E. L. Parsons, Solar Turbines, Inc., San Diego, California, SAE Technical Paper Series 851254; "Development, Fabrication and Application of a Primary Surface Gas Turbine Recuperator,"; Government/Industry Meeting & Exposition, Washington, D.C., May 20–23, 1985.

* cited by examiner

*Primary Examiner*—Leonard Leo
(74) *Attorney, Agent, or Firm*—Finnegan, Henderson, Farabow, Garrett & Dunner, L.L.P.

(57) ABSTRACT

A coiled heat exchanger and a method of making a coiled heat exchanger including a pair of sheets coiled together to form a core having opposite faces. A first sheet has at least one edge extending substantially coplanar with the sheet. A second sheet has at least one edge having alternating portions along the edge being respectively raised and unraised with respect to the plane of the sheet such that when the sheets are coiled together the at least one edge of the second sheet is configured to abut portions of the at least one edge of the first sheet at locations corresponding to the alternating raised portions. These edges and their alternately abutting portions form openings in the form of angular sectors on a face of the core that are configured to pass fluid therethrough.

22 Claims, 2 Drawing Sheets

SPIRAL HEAT EXCHANGER

CROSS-REFERENCE TO RELATED APPLICATIONS

This application is a National Stage Application of International Application PCT/BE97/00088, filed on Jul. 28, 1997.

FIELD OF THE INVENTION

The present invention relates to coiled heat exchangers having a spiral configuration. In these types of heat exchangers, heat transfer fluids enter, circulate, and exit the heat exchanger in a counterflow manner in a direction substantially parallel to the coil's longitudinal axis.

BACKGROUND OF THE INVENTION

Though numerous applications utilize coiled heat exchangers, the gas turbine recuperator is among the most demanding. In any application, and especially when used as a gas turbine recuperator, the heat exchanger should be compact, efficient, reliable, and relatively inexpensive to manufacture. By designing the primary heat transfer surface with small hydraulic diameters and counterflow circulation of heat transfer fluids, a relatively compact and efficient heat exchanger can be obtained. Furthermore, providing the heat exchanger with relatively large cross-sectional flow areas reduces load losses. Achievement of large cross-sectional flow areas in coiled heat exchangers requires circulating heat transfer fluids in the axial, as opposed to tangential, direction. Additionally, production costs can be lowered by minimizing the number of elements used to make the heat exchanger and by forming and coiling the heat exchanger in a continuous process. Another design consideration, especially when used as a gas turbine recuperator, includes resistance to thermal shock. Heavy thermal loads often result from the transient operation of turbines. Therefore, to ensure reliable performance and operation, the heat exchanger should have high resistance to thermal shock.

Various known heat exchangers are made from coiling a pair of sheets between which heat transfer fluids circulate in a counterflow manner in directions substantially parallel to the longitudinal axis of the coil. For example, U.S. Pat. No. 5,797,449 pertains to an annular heat exchanger formed by a pair of sheets welded together and coiled, with openings cut through the sheets through which heat transfer fluid passes.

German patents DE 1121090 and DE 3234878 describe spiral heat exchangers having axially circulated fluid flows, in which the fluids enter and exit through alternating angular sectors. In DE 1121090, sectors for circulating the heat transfer fluids are formed by cutting evenly-spaced openings in borders that close the edges of a pair of sheets coiled to form the heat exchanger. After the borders are cut, the two sheets are coiled to form the heat exchanger. DE 1121090 additionally discloses the fabrication of the spiral heat exchangers with external headers.

In DE 3234878, the sectors are formed by glueing blocking segments on the two faces of the coiled heat exchanger.

Finally, in French patent document FR-A-2319868, borders are closed by the direct welding of adjacent sheets.

A particular difficulty in heat exchangers having a coiled configuration includes the distribution of the single incoming flow into the myriad of small heat transfer passages and the collection of the same into a single outgoing flow after the heat transfer has taken place. Preferably, this distributing and collecting should not result in excessive head losses, nor should it cause mechanical stresses due to large thermal gradients. Another difficulty arises from blockages to the heat transfer fluids that exist on the core face as the result of the particular construction used for the heat exchanger. For instance, in one known example, the sheets are constructed and cut such that one sheet has openings only for one fluid and the other has openings only for the other fluid. This leads to a relatively high amount of fluid being blocked at the core faces, thus reducing gas flow passage and overall efficiency of the heat exchanger.

Stacked plate heat exchangers often include openings cut in the plates to distribute and collect the heat transfer fluids. The edges of these openings generally are either brazed or welded together during assembly of the heat exchanger (for example in U.S. Pat. No. 4,073,340) or are fitted with a gasket (for example in Alfa-Laval plate heat exchangers). Other stacked plate heat exchangers do not include such openings (see SAE 851254: "Development, Fabrication, and Application of a Primary Surface Gas Turbine Recuperator", E.L. Parsons), but the sides of the plates must be provided with sealing bars.

SUMMARY OF THE INVENTION

The invention relates to a heat exchanger formed by coiling a pair of sheets. According to an aspect of the invention a coiled heat exchanger comprises a first sheet having at least one edge extending substantially coplanar with the first sheet and a second sheet having at least one edge with alternating portions along a length of the edge being respectively raised and unraised with respect to a plane of the second sheet. The at least one edge of the second sheet is configured to abut portions of the at least one edge of the first sheet at locations corresponding to the alternating raised portions when the first and second sheets are coiled together.

According to another aspect of the invention, a cylindrical heat exchanger made by coiling a pair of sheets includes a pair of adjacent sheets coiled together so as to form angular sectors on opposite faces of the cylindrical heat exchanger, said angular sectors being formed by alternating raised portions disposed along the edge of one sheet abutting portions along the edge of the other sheet. The pair of sheets further includes ripples extending substantially parallel to the longitudinal axis of the cylindrical heat exchanger on one sheet of the pair of sheets and ripples extending substantially perpendicular to the longitudinal axis of the cylindrical heat exchanger on the other sheet of the pair of sheets. A sum of the heights of corresponding ripples on each sheet is a constant along an axial length of the heat exchanger from one face to the other and the constant is equal to a height of the alternating raised portions on the edge of the second sheet, as measured from a plane of the second sheet. The two sheets are one of joined and brazed at contact points of crests of the respective ripples of each sheet.

According to yet another aspect of the invention, a cylindrical heat exchanger made by coiling a pair of sheets comprises essentially the same elements as those listed in the preceding paragraph except that fins extend on the sheets rather than ripples.

Yet another aspect of the invention includes a heat exchanger formed by coiling a pair of sheets comprising a cylindrical core having two opposite faces with a plurality of openings in the form of angular sectors around a longitudinal axis of the core. The core is formed by coiling a first sheet having at least one edge extending substantially coplanar with the first sheet with a second sheet having at least one edge with alternating portions along the edge being respectively raised and unraised with respect to the plane of the second sheet. The raised portions of the edge of the second sheet abut portions of the edge of the first sheet and the angular sector openings are partially defined by the abutting portions of the edges of the first and second sheets.

According to yet another aspect of the invention, a method of forming a coiled heat exchanger includes providing a first sheet having at least one edge extending substantially coplanar to the first sheet and providing a second sheet having at least one edge with alternating portions along the edge being respectively raised and unraised with respect to a plane of the second sheet. The method further includes placing the first and second sheets together such that their edges are substantially aligned with one another and coiling the first and second sheets together such that the alternating raised portions of the edge of the second sheet abut portions of the edge of the first sheet.

BRIEF DESCRIPTION OF THE DRAWINGS

The accompanying drawings, which are incorporated in and constitute a part of this specification, illustrate the preferred embodiments of the invention and, together with the description, serve to explain the principles of the invention. In the drawings.

DETAILED DESCRIPTION OF THE PREFERRED EMBODIMENT

The present invention relates to a heat exchanger formed by coiling a pair of sheets. The heat transfer fluids flow in a counterflow direction to one another, substantially parallel to the longitudinal axis of the coil. The fluids enter and exit the heat exchanger at opposite faces of the cylinder formed by coiling the sheets. By providing entry and exit in this manner, distributing openings need not be disposed inside the heat exchanger. As a result of eliminating these distributing openings, stress concentrations, welding problems, and difficulties with inspection and repair on juncture lines within the heat exchanger are reduced. In addition, the size and shape of the distributor can vary as desired for a particular application since they preferably are entirely external to the heat exchanger core, that is, the cylinder formed by coiling the sheets.

The coiled heat exchanger according to the present invention also eliminates the need to provide sealing bars because no open edges exist. Using the coiled sheets of the invention, which will be described shortly, facilitates the creation of heat transfer fluid entry and exit passages.

Figure 1:
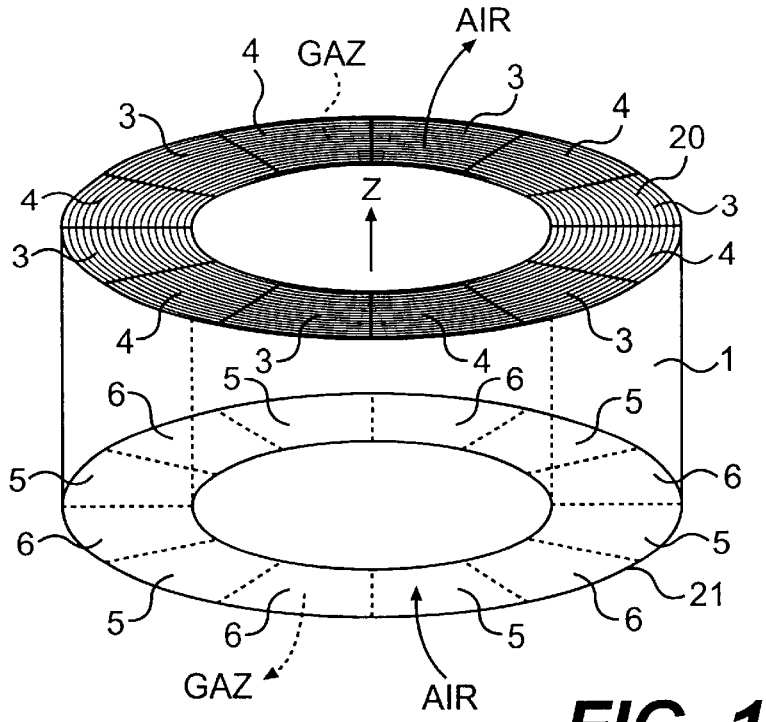
FIG. 1 is a perspective view of the heat exchanger according to an embodiment of the present invention, with arrows indicating incoming and outgoing heat transfer fluid flows.
Figure 3:
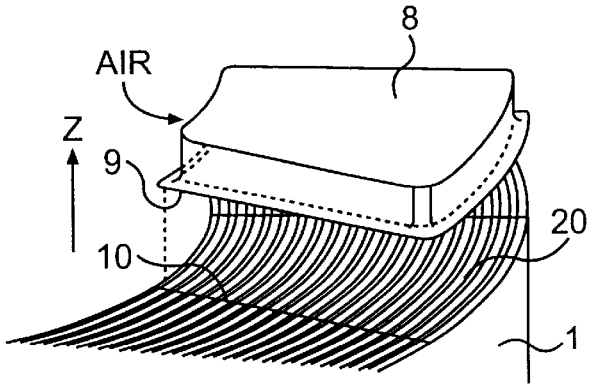
FIG. 3 is an exploded view of an angular air inlet sector with its distribution header according to an embodiment of the present invention.

As shown in FIG. 1, the heat exchanger of the present invention forms a core 1 having a cylindrical configuration. Heat exchanger core 1 is made by coiling a pair of sheets a and b together, as will be explained shortly. External headers 8 attach to a first face 20 of core 1, as shown in FIG. 3.

On a second face 21 of the core, a first heat transfer fluid, such as air, flows in through angular sectors 5, which are evenly spaced around second face 21 in an alternating pattern with angular sectors 6. Angular sectors 6 exit a heat transfer gas through second face 21 of core 1. On first face 20, angular sectors 3 and 4 correspond to angular sectors 5 and 6, respectively. Angular sectors 3 exit air from first face 20 of core 1 while angular sectors 4 intake gas to pass through core 1.

Figure 4:
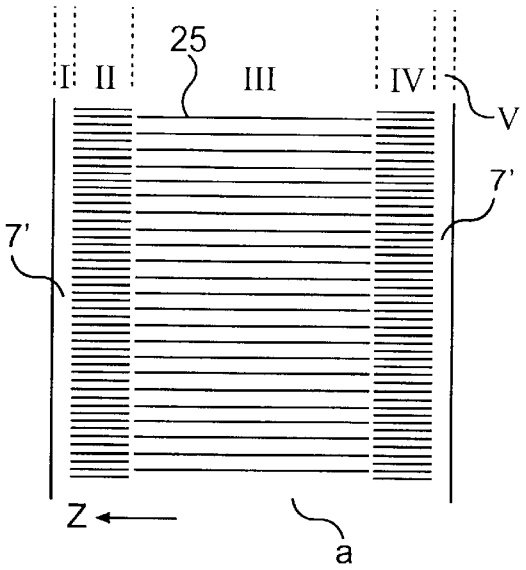
FIG. 4 is a plan partial view of one of the sheets (sheet a) before coiling, the sheet having a corrugated surface with ripples or fins extending parallel to the longitudinal axis of the heat exchanger core according to an aspect of the invention.
Figure 5:
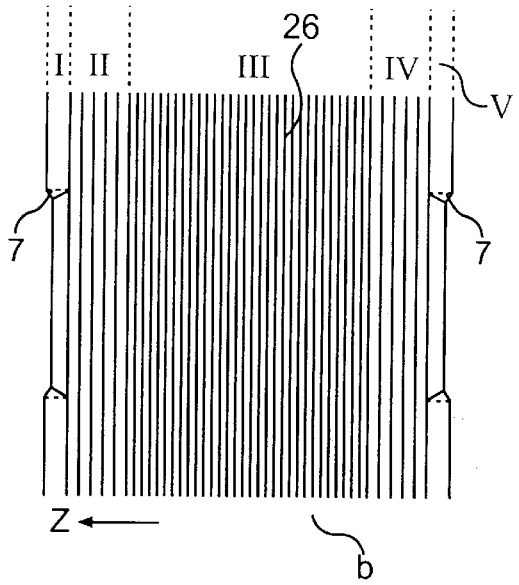
FIG. 5 is a plan partial view of one of the sheets (sheet b) before coiling, the sheet having a corrugated surface with ripples or fins extending perpendicularly to the longitudinal axis of the heat exchanger core according to an aspect of the invention.

Sheets a and b forming heat exchanger core 1 have surfaces as shown best in FIGS. 4 and 5. That is, sheet a includes ripples 25 that extend essentially transverse to the sheet and are substantially parallel to the longitudinal axis (or coiling axis) of the heat exchanger core, i.e., the z-axis in FIGS. 4 and 5, once the sheets have been coiled. Ripples 25 form three zones, zone II and IV along the edges of sheet a and zone III in a central region of sheet a. Ripples in zone II and IV are relatively closely-spaced together and have lengths that extend a relatively short distance from respective edges 7' of sheet a. Ripples in zone III on the other hand have greater distances between them and extend the entire region from zone II to zone IV. In fact, as shown in FIG. 4, these ripples can align with some ripples in zone II and IV to create a smooth transition between zone III and zone II and IV, respectively. Zones I and V on sheet a have no ripples and form edges 7' of the sheet. These edges extend substantially coplanar with the remaining portions of the sheet a.

As shown in FIG. 5, sheet b includes ripples 26 that extend essentially longitudinal to the sheet and are substantially perpendicular to the coiling axis after the sheets have been coiled to form the core. The ripples of sheet b also are disposed on zone II through IV corresponding to the zones of sheet a such that the respective zones align when the two plates are laid over one another. Ripples 26 extend the entire length of sheet b. Zones I and V forming edges 7 of sheet b are alternately depressed and raised along a length of edges 7 (i.e., in a direction parallel to ripples 26) such that the raised portions extend above (when the sheet is observed from the side on which the ripples are formed) the plane of the remaining portions of sheet b. These alternating raised and depressed portions essentially form ears for fluid inlet/outlet (see FIGS. 2 and 5) when the sheets are coiled together.

The ripples on sheets a and b are essentially protrusion members formed as part of the sheets. Alternatively, the protrusion members may be in the form of fins disposed on flat plates.

Figure 2:
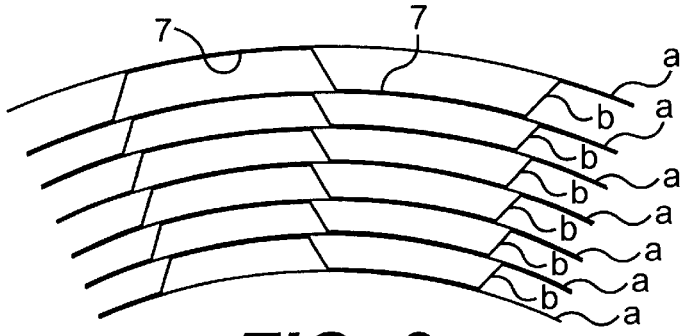
FIG. 2 is a partial cross-sectional view of a heat exchanger taken in a plane perpendicular to the longitudinal axis and showing the stacks of coils formed by coiling two sheets a and b of the heat exchanger according to an embodiment of the present invention.

When sheet b is put together with sheet a such that the edge regions 7 and 7' of the two sheets mate with one another, as shown in FIG. 2, these alternately raised and depressed regions form the openings for fluid entry and exit. Thus, the raised portions of the edges 7 of sheet b abut edge 7' of sheet a during the coiling operation. After the entire heat exchanger core has been-formed by the coiling of sheets a and b, the edges 7 and 7' may be joined together, preferably by brazing for example.

Formation of the alternating raised and lowered portions of edge 7 of sheet b preferably is accomplished during the coiling of the two sheets. In order to form well-defined angular sectors of appropriate size, the raising of edge 7 should be carefully synchronized with the coiling process such that the inlets and outlets, or ears, that are formed increase in length after each coiling turn and are in angular phase with one another in order to form well-shaped angular sectors.

Figure 6:
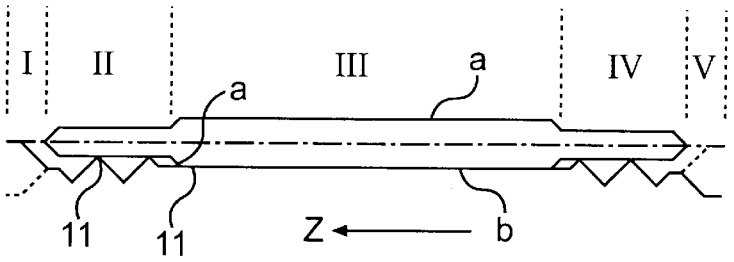
FIG. 6 is a partial radial sectional view of sheets assembled together to form a heat exchanger according to an aspect of the invention.

The sum of the height of ripples 25 and 26 on sheets a and b remains constant throughout zone II through IV. The summed height should be equal to the variation of height of the raised portions in zones 1 and V of sheet b as measured from the plane of that sheet so that the thickness of the pair of plates remains constant, as shown in FIG. 6. By maintaining a constant thickness, radial deformation resulting from coiling sheets a and b can be avoided.

Sheets a and b preferably join together along the crests of ripples 25 and 26 and contact at points 11, as shown in FIG. 6. Contact points 11 essentially form a cross-ruling pattern at the intersection of the ripple crest lines. Joining the portions of the pair of sheets that circulate the higher pressure fluid therebetween, achieves a local containment of that fluid overpressure. This eliminates the need to provide a pressure vessel. Such joining preferably is accomplished by brazing, however other suitable like joining techniques may also be used.

Figure 7:
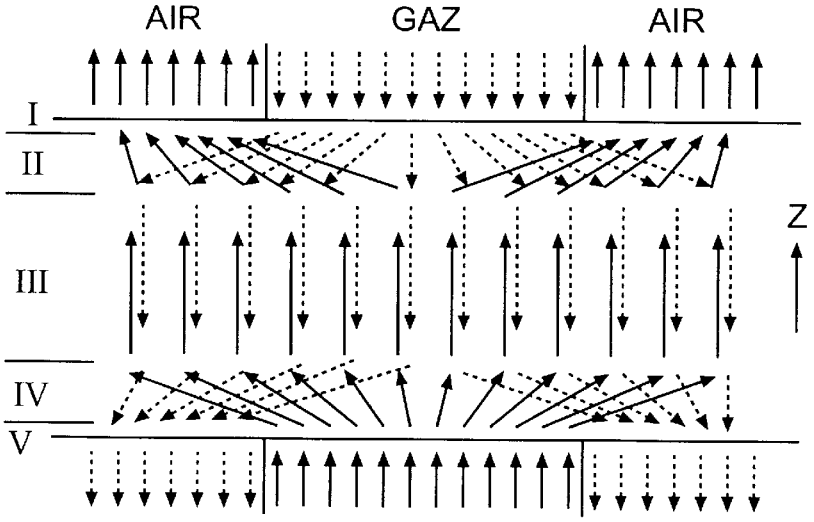
FIG. 7 is a plan partial view of the paths of air and gas between a pair of sheets, from one face of the heat exchanger to the other according to an aspect of the invention.

Ripples 25 and 26 in zone II and IV of both sheets a and b have similar heights. These ripples contact each other at their crests as explained with reference to FIG. 6 and lie essentially perpendicular to one another. Due to the relative configurations and orientations of ripples 25 and 26, zone II and IV enable the heat transfer fluids, for example air and gas, to pass in both axial and tangential directions, as shown in FIG. 7. Zones II and IV therefore essentially serve as distributing or collecting zones to initially distribute and ultimately collect the fluid flowing through heat exchanger core 1. As indicated by the arrows in FIG. 7, zone II and IV essentially provide for a cross-flow of the two heat transfer fluids circulating through the heat exchanger.

After distribution in zone II and IV, the fluid flows are directed into zone III. As a result of the relatively large axially-directed ripples 25 on sheet a and the relatively small tangential ripples 26 on sheet b, as well as the relative spacings between the ripples, the flow occurs substantially parallel to the coiling axis of core 1. The heat transfer fluid flows encounter each other in a counterflow manner due their respective entries at opposite faces of core 1, as was described with reference to FIG. 1.

After core 1 has been formed with the above-described coiling process, headers 8 can be fixed to the core faces. Headers 8 are aligned with angular sectors as shown in FIG. 3 and their rims 9 fixed to the edges 10 forming the angular sectors. Brazing the headers to the core faces represents one technique that may be employed to fix the headers to the core, however other suitable joining techniques are also contemplated by the invention.

What is claimed is:

1. A coiled heat exchanger, comprising:

a first sheet having opposed edges with at least one of the edges extending substantially coplanar with the first sheet; and a second sheet having at least one edge with alternating portions along the edge being respectively raised and unraised with respect to a plane of the second sheet, said at least one edge of the second sheet being configured to abut portions of the at least one edge of the first sheet at locations corresponding to the alternating raised portions when the first and second sheets are coiled together.

2. The heat exchanger of claim 1, wherein the first sheet includes at least one protrusion member extending in a direction substantially parallel to a longitudinal axis of the coiled heat exchanger.

3. The heat exchanger of claim 2, wherein the protrusion member is chosen from one of ripples and fins.

4. The heat exchanger of claim 1, wherein the second sheet includes at least one protrusion member extending in a direction substantially perpendicular to a longitudinal axis of the coiled heat exchanger.

5. The heat exchanger of claim 4, wherein the protrusion member is chosen from one of ripples and fins.

6. The heat exchanger of claim 1, wherein one of ripples and fins are disposed on surfaces of the first and second sheets, said one of ripples and fins on each surface being configured to abut each other when the sheets are coiled together and said one of ripples and fins being further configured to form a distribution zone near the edges of the sheets and a substantially longitudinal flow zone between the edges.

7. The heat exchanger of claim 6, wherein heat transfer fluids circulating in the heat exchanger flow in a cross-flow manner within the distribution zone and in a counterflow manner in the longitudinal flow zone.

8. The heat exchanger of claim 1, further comprising at least one protrusion member disposed on at least one surface of each of the sheets and configured to contact one another when the sheets are coiled together.

9. The heat exchanger of claim 8, wherein a sum of a height of corresponding protrusion members on each sheet when coiled together is equal to a height of the raised portions of the edge of the second sheet.

10. The heat exchanger of claim 8, wherein the protrusion members contact one each other at respective crests of the protrusion members.

11. The heat exchanger of claim 10, wherein the sheets are joined together at the points of contact of the crests.

12. The heat exchanger of claim 11, wherein the sheets are joined together by brazing.

13. The heat exchanger of claim 1, wherein the first and second sheets form a core when coiled together, said core having two opposite faces formed by the edges of the first and second sheets.

14. The heat exchanger of claim 13, wherein the at least one edge of the first sheet and the at least one edge of the second sheet form openings configured to pass a fluid therethrough in at least one of said faces of the core when the sheets are coiled together.

15. The heat exchanger of claim 14, wherein the openings are in the form of angular sectors around a longitudinal axis of the core.

16. The heat exchanger of claim 14, wherein there are two sets of openings alternating with one another around a longitudinal axis of the core, said first set of openings configured to receive a first heat transfer fluid for circulating through the heat exchanger and the second set of openings configured to exit a second heat transfer fluid after having been circulated through the heat exchanger.

17. The heat exchanger of claim 14, wherein two edges of the first sheet extend substantially coplanar with the sheet and two edges of the second sheet have alternating portions being respectively raised and unraised with respect to a plane of the second sheet, the two edges of each sheet being configured to abut one another at locations corresponding to the alternating raised portions of the second sheet and to form openings configured to pass a fluid therethrough in the two opposite faces of the core when the sheets are coiled together.

18. The heat exchanger of claim 13, further comprising at least one header disposed on at least one of the faces of the core.

19. The heat exchanger of claim 13, wherein the core is a cylindrical core.

20. A heat exchanger formed by coiling a pair of sheets, comprising:

a cylindrical core having two opposite faces with a plurality of openings in the form of angular sectors around a longitudinal axis of the core, said core formed by coiling a first sheet having opposite edges with at least one of the edges extending substantially coplanar with the first sheet with a second sheet having at least cone edge with alternating portions along the edge being respectively raised and unraised with respect to a plane of the second sheet, said raised portions of the edge of the second sheet abutting portions of the edge of the first sheet and the angular sector openings being partially defined by the abutting portions of the edges of the first and second sheets.

21. A cylindrical heat exchanger made by coiling a pair of sheets, comprising:

a pair of adjacent sheets coiled together so as to form angular sectors on opposite faces of the cylindrical heat exchanger, said angular sectors being formed by alternating raised portions on the edge of one sheet abutting portions of the edge of the other sheet, said pair of adjacent sheets further including ripples extending substantially parallel to the longitudinal axis of the cylindrical heat exchanger on one sheet of said pair of sheets, and ripples extending substantially perpendicular to the longitudinal axis of the cylindrical heat exchanger on the other sheet of said pair of sheets, a sum of the heights of the corresponding ripples on each face being a constant along an axial length of the heat exchanger from one face to the other and said constant being equal to a height of the alternating raised portions on the edge of the second sheet as measured from a plane of the second sheet, wherein the two sheets are one of joined and brazed at contact points of crests of the respective ripples of each sheet.

22. A cylindrical heat exchanger made by coiling a pair of sheets, comprising:

a pair of adjacent sheets coiled together so as to form angular sectors on opposite faces of the cylindrical heat exchanger, said angular sectors being formed by alternating raised portions on the edge of one sheet abutting portions of the edge of the other sheet, said pair of adjacent sheets further including fins extending substantially parallel to the longitudinal axis of the cylindrical heat exchanger on one sheet of said pair of sheets, and fins extending substantially perpendicular to the longitudinal axis of the cylindrical heat exchanger on the other sheet of said pair of sheets, a sum of the heights of the corresponding fins on each face being a constant along an axial length of the heat exchanger from one face to the other and said constant being equal to a height of the alternating raised portions on the edge of the second sheet as measured from a plane of the second sheet, wherein the two sheets are one of joined and brazed at contact points of crests of the respective fins of each sheet.

* * * * *

UNITED STATES PATENT AND TRADEMARK OFFICE

CERTIFICATE OF CORRECTION

PATENT NO. : 6,263,961 B1
DATED : July 24, 2001
INVENTOR(S) : Hubert Antoine

It is certified that error appears in the above-identified patent and that said Letters Patent is hereby corrected as shown below:

Title page,
Item [75], please delete "Earneux (BE)" and replace therfor -- Esneux (BE) --.

Column 7, claim 20,
Line 28, please delete "cone" and replace therfor -- one --.

Signed and Sealed this

Twenty-fifth Day of December, 2001

*Attest:*

*Attesting Officer*

JAMES E. ROGAN
*Director of the United States Patent and Trademark Office*